US005692188A

United States Patent [19]

Watts et al.

[11] Patent Number: 5,692,188

[45] Date of Patent: Nov. 25, 1997

[54] SYSTEM FOR PROCESSING AND WASHING PHOTOGRAPHIC IMAGES

[76] Inventors: Todd A. Watts, 167 Spring St., #5 SE.; Leonardo Sideri, 561 Broadway, both of New York, N.Y. 10012

[21] Appl. No.: 584,378

[22] Filed: Jan. 11, 1996

[51] Int. Cl.[6] ..... G03D 13/08

[52] U.S. Cl. ..... 396/634; 396/635

[58] Field of Search ..... 354/298, 308, 354/310–313, 316–324, 331, 336, 300; 355/44, 211, 27; 396/569, 604, 609, 634, 635, 636, 947, 948, 949

[56] References Cited

U.S. PATENT DOCUMENTS

| | | | |
|---|---|---|---|
| 938,287 | 10/1909 | Taylor | 354/323 |
| 3,187,659 | 6/1965 | Edens et al. | 118/246 X |
| 3,554,107 | 1/1971 | McCarthy et al. | 354/298 |
| 3,554,108 | 1/1971 | Gall | 354/323 X |
| 3,559,558 | 2/1971 | Hamlin et al. | 354/317 |
| 3,626,835 | 12/1971 | Buechner | 354/330 |
| 3,644,036 | 2/1972 | Canfield | 354/312 X |
| 3,747,499 | 7/1973 | Foster | 354/322 X |
| 3,856,359 | 12/1974 | Comstock | 354/331 |
| 3,890,629 | 6/1975 | Huss | 354/323 X |
| 4,104,671 | 8/1978 | Harrigan | 354/331 |
| 4,178,088 | 12/1979 | Harding | 354/300 |
| 4,288,155 | 9/1981 | Patrick | 354/308 |
| 4,332,455 | 6/1982 | Stettner | 354/324 |
| 4,375,325 | 3/1983 | Eng | 354/318 |
| 4,695,146 | 9/1987 | Fuller | 354/309 |
| 5,023,654 | 6/1991 | Matsumoto et al. | 355/27 |
| 5,255,056 | 10/1993 | Preszler et al. | 355/211 |

FOREIGN PATENT DOCUMENTS

| | | | |
|---|---|---|---|
| 281917 | 8/1962 | Netherlands | 354/329 |

*Primary Examiner*—D. Rutledge

*Attorney, Agent, or Firm*—St.Onge Steward Johnston & Reens LLC

[57] ABSTRACT

A drum photographic processor is provided which comprises a trough for receiving processing liquid, a drum mounted within the trough in contact with the liquid, the drum having an outer surface for mounting the photographic sheet material such that a non-emulsion side of the sheet material contacts the drum outer surface, a motor for rotating the drum outer surface to pass an emulsion side of the sheet material through the liquid in the trough, and a groove on the outer surface of the drum for receiving an edge of the photographic material off of the drum surface as it is rotated through the liquid. In another aspect, the invention provides a method of processing photographic material using the drum photographic processor.

18 Claims, 5 Drawing Sheets

SYSTEM FOR PROCESSING AND WASHING PHOTOGRAPHIC IMAGES

FIELD OF THE INVENTION

The invention relates to a drum processor and method for processing and washing photographic images. More specifically, the invention relates to a multiple pass, dip-type drum processor for processing and washing photographic images.

BACKGROUND OF THE INVENTION

Drum processors for photographic images are known in the prior art and may be categorized by the way in which the drum is used in processing the photographic material.

U.S. Pat. Nos. 3,187,657 (Edens) and 4,375,325 (Eng) disclose applicator-type drum processors in which the drum is used to apply processing chemicals to the emulsion side of photographic materials. A disadvantage of these processors is that application of processing chemicals by contact between the drum and emulsion may adversely affect image quality due to scratching or streaking.

U.S. Pat. No. 938,287 (Taylor) discloses one example of inner-type drum processors in which exposed photographic material is manipulated into the inside of the drum for processing. Taylor discloses a mechanism for loading photographic material into the drum which necessitates contact between the mechanism and the emulsion side of the material. The Taylor mechanism thus suffers the same disadvantage as applicator-type processors.

U.S. Pat. Nos. 3,559,558 (Hamlin) and 4,288,155 (Patrick) disclose one-pass-type drum processors in which the drum is rotated only a single time to process the image with several distinct steps and/or chemicals. The Hamlin device is designed to process photolithographic plates using sprays, pressure rolls, and squeegees/wipers. The Patrick device is a diazotype developer which uses a gaseous developing medium. Neither is suited for or was designed for photographic developing. A further disadvantage of these as well as applicator-type and inner-type drum processors is that the operator can not see the image as it develops and thus has little or no real-time control over processing.

U.S. Pat. No. 3,890,629 (Huss) discloses a drum developing device wherein the tank and chemical reservoirs are all immersed in a common, thermostatically controlled water jacket. U.S. Pat. No. 4,178,088 (Harding) discloses a photographic drum processor in which the drum includes a helical rib for receiving edges of exposed material to hold it away from the drum. U.S. Pat. No. 3,554,108 discloses a similar helical supporting member (FIG. 8) and also discloses holding rods for loosely mounting exposed photographic material to a drum. A disadvantage of these are other drum processors in which processing chemicals contact non-emulsion sides of photographic material is that extensive washing is required in order to minimize the possibility that processed photographic images are free from embedded processing chemicals which may degrade or destroy the photographic images over time.

These disadvantages of prior art drum processors are exacerbated when large-scale or museum quality photographic images are attempted to be processed, that is by photographic processing as art and not just reminiscence. Large-scale images are difficult to handle and load into prior art drum processors. Further, prior art devices are generally best suited to production of high volumes but not high quality images since they provide very little user control over processing.

Large scale images are generally only developed by photo finishing establishments using very large roller transport machines which automatically advance exposed photographic material through successive trays of processing chemicals. Disadvantages of these prior art devices are similar to those for the various types of drum processor: Contact between transport mechanism and emulsion side of the photographic material, operator can not see the image as it develops, and contact between processing chemicals and non-emulsion side of the photographic material exacerbates archival washing.

What is desired, therefore, is a drum processor and method which is relatively easy to load and use, and which enables high quality processing of photographic material including large-scale images.

SUMMARY OF THE INVENTION

Accordingly, it is an object of the invention to provide a drum photographic processor which is relatively simple and dependable in use.

Another object of the invention is to provide a drum photographic processor for producing high quality, large scale images.

A further object of the invention is to provide a drum photographic processor in which the entire non-emulsion side of the photographic material is in contact with a surface of the drum.

Yet another object of the invention is to provide a drum photographic processor of the above character in which the drum includes a longitudinal groove for receiving an edge of the photographic material.

Still another object of the invention is to provide a method of processing photographic images using a drum photographic processor of the above character.

These and other objects are achieved by provision of a drum photographic processor comprising a trough for receiving processing liquid; a drum mounted within said trough in contact with the liquid, said drum having an outer surface for mounting the photographic sheet material such that a non-emulsion side of the sheet material is completely in contact with the drum outer surface; motor means for rotating said drum outer surface to pass an emulsion side of the sheet material through the liquid in said trough; and a groove in said outer surface of said drum, said groove aligned substantially parallel to the drum axis for receiving an edge of the photographic material to prevent the liquid from peeling the photographic material from said drum surface as it is rotated through the liquid while permitting the emulsion side of the sheet material to be completely in contact with the liquid.

Preferably, the drum photographic processor includes a cover for enclosing said trough and drum outer surface, said cover including a window extending along said drum and permitting a user to view the photographic material during processing. The drum photographic processor preferably also includes a pump connected to said trough for increasing the speed and efficiency with which the processing liquids are removed from the trough permitting a user to precisely control the amount of time the photographic material is passed through the liquid.

The groove preferably comprises a lip having a height substantially equal to about a thickness of the photographic material. Most preferably, the groove comprises an inverted wall forming a wedge-shaped slot for receiving the edge in an interference fit.

The drum preferably includes axial shaft portions supported by rollers for mounting the drum within the trough. Resilient bands stretched around the rollers aid to cushion and grip the shaft portions. In this regard, the motor means functions to advance one of the resilient bands.

In another aspect, the invention relates to a method for processing photographic images comprising the steps of wetting the drum outer surface with an inert liquid; inserting an edge of the photographic material into a groove on an outer surface of the drum; applying the photographic material to the drum by advancing the drum up to one revolution and insuring that a non-emulsion side of the material is completely in contact with the drum outer surface; rotating the drum to pass an emulsion side but not the non-emulsion side of the material completely through processing liquid within a trough; viewing the photographic material through a window in a cover on the trough; and pumping the processing liquid out of the trough upon obtaining a desired image on the photographic material as determined by viewing.

The invention and its particular features and advantages will become more apparent from the following detailed description considered with reference to the accompanying drawings.

DETAILED DESCRIPTION OF THE INVENTION

Figure 1:
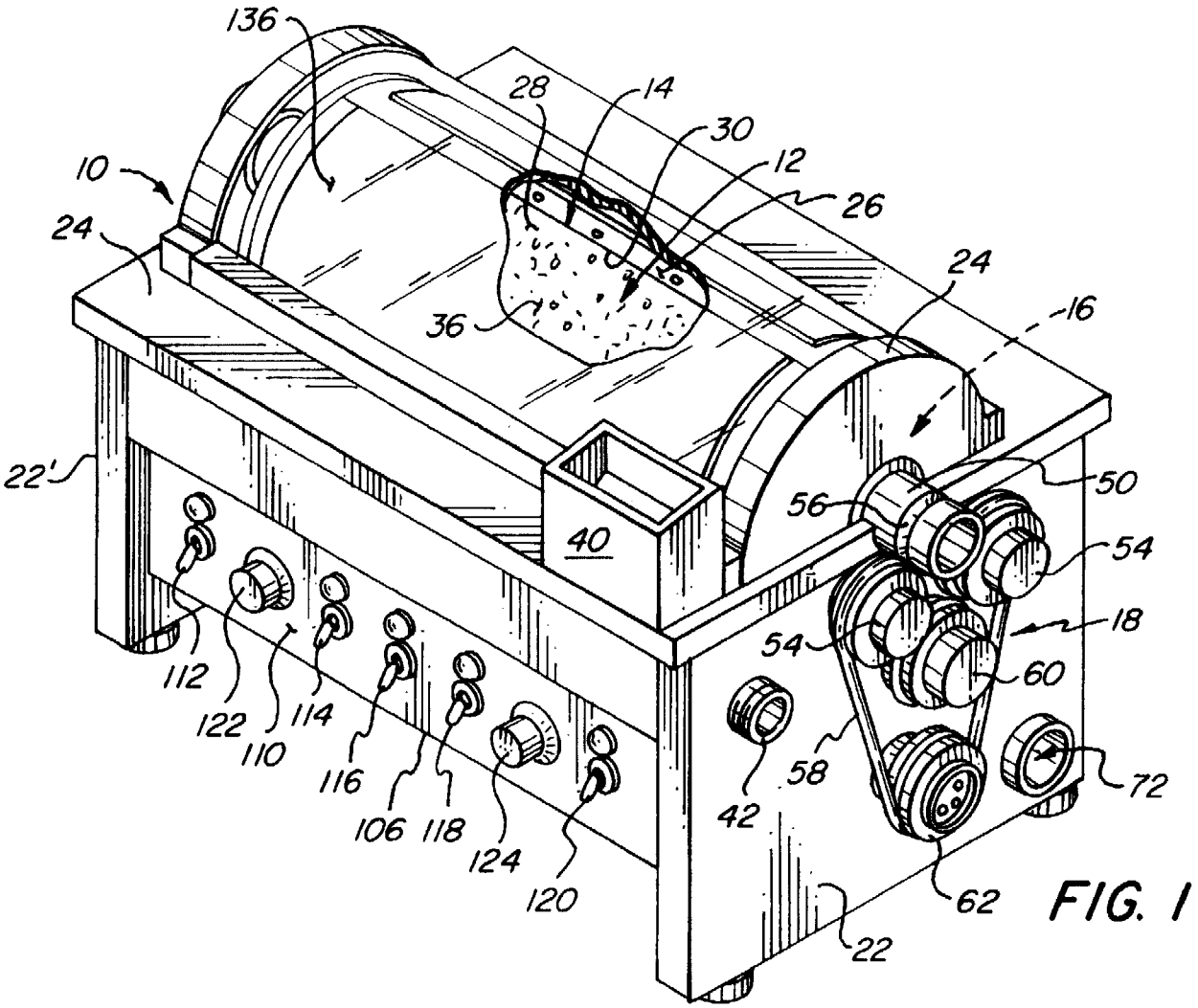
FIG. 1 is a front isometric view of a drum photographic processor in accordance with the invention.
Figure 2:
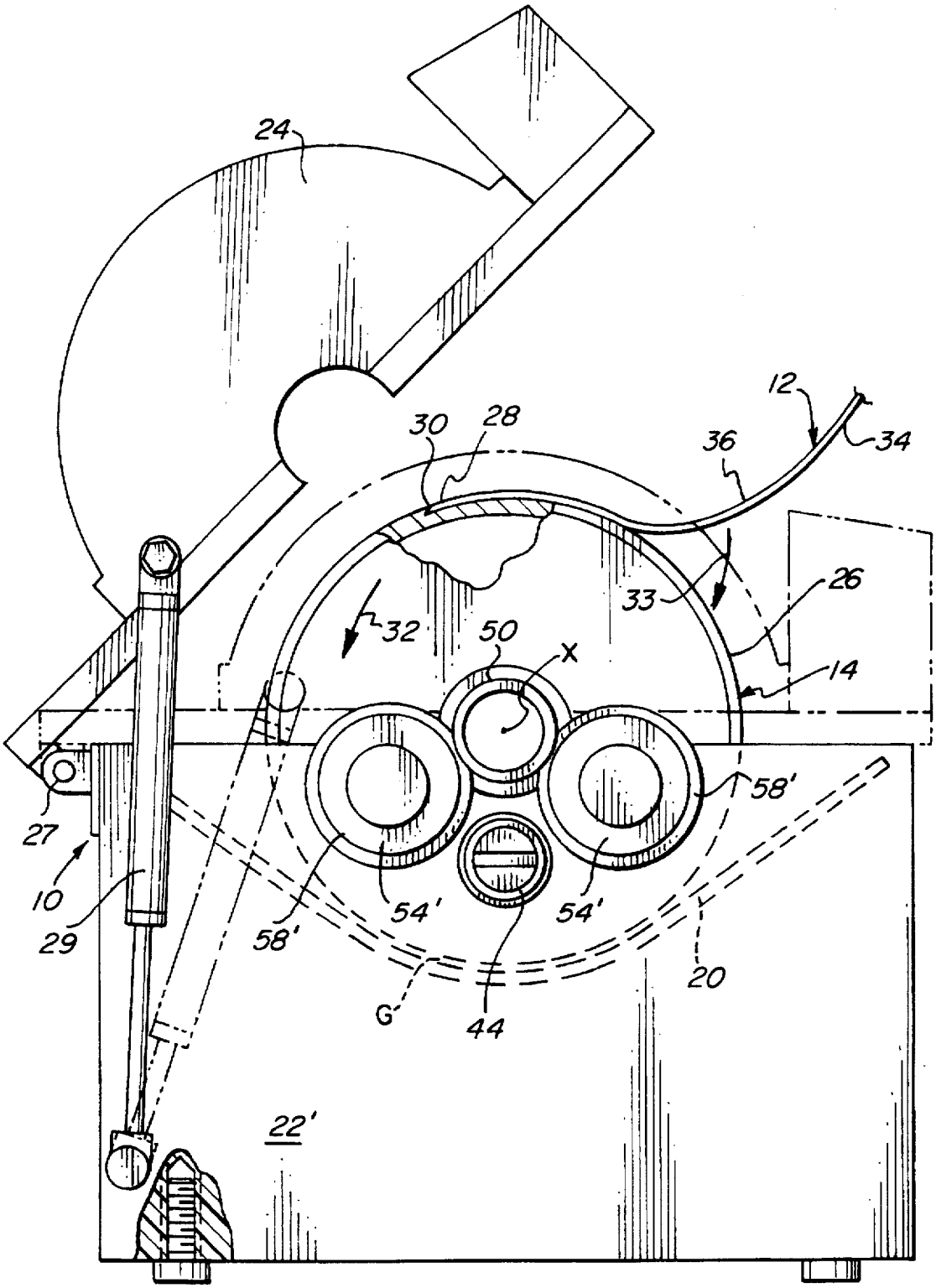
FIG. 2 is a left side elevation view of the drum photographic processor of FIG. 1 with the cover raised to demonstrate loading of photographic material on the drum thereof.

Referring to FIGS. 1 and 2, a drum processor 10 for processing photographic sheet material 12 in accordance with the invention is generally shown. Processor 10 comprises a drum 14, a processing chamber 16, and a drum rotating mechanism 18. Processing chamber 16 is enclosed by trough 20, walls 22, 22' and a cover 24.

For processing, photographic material 12 is applied to an outer surface 26 of drum 14. First, cover 24, which is hinged at 27 to processor 10, must be lifted (see FIG. 2). A rod and a cylinder 29 retains cover 24 in an upright, lifted position permitting access to drum 14. Next, an edge 28 of the material is set into a groove 30 arranged longitudinally on drum outer surface 26 and drum 14 is then rotated as indicated by arrow 32 while a non-emulsion side 34 of the material is smoothed onto surface 26 as indicated by arrow 33. Preferably, non-emulsion side 34 is completely in contact with drum outer surface 26 while emulsion side 36 of photographic material 12 is completely exposed for treatment by processing chemicals. In this regard, groove 30 is preferably aligned substantially parallel with a drum axis X and drum processor 10 is capable of processing photographic sheet material 12 with dimensions as large as a length L of drum 14 and 628 times a radius R of drum 14 (see FIGS. 5–6).

Processor 10 enables an artist or photo enthusiast to personally process large-scale photographic images relatively easily with high quality and relatively inexpensively with few materials and in a small space. Currently, artists or photo enthusiasts desiring large-scale images must send them to photo finishing establishments charging relatively high costs and providing relatively low quality. These establishments often use roller transport machines which suffer many of the disadvantages of other types of prior art photographic processing machines. Most importantly, however, to artists and photo enthusiasts is that sending their work to photo finishing establishments means they are unable to personally affect and control the developing process, that is, they are unable to practice their art or hobby.

Processing chemicals or liquids 15 (see FIG. 4) are introduced into processing chamber 16 at end 22 either by a light-proof filler receptacle 40 for pouring liquids, or by a fitting 42. Fitting 42 may, for example, be connected to a metering or temperature controlling device for processing chemicals, or to a water line for continuous washing of photographic material 12 after processing. When not in use, a plug or cap (not shown in any Figure) is used to seal fitting 42.

Liquids entering trough 20 near end 22 of processor 10 flow along the trough in contact with emulsion side 36 of material 12 and with drum outer surface 26 toward end 22' of processor 10. End 22' includes an overflow port 44. Overflow port 44 is not generally used during processing with active chemicals but may be used for example during washing of a processed image or during flushing of processor 10. Preferably, a pipe or hose is connected to port 44 for carrying overflow liquid to an appropriate drain (not shown in any Figure). Especially where it is used to introduce washing or flushing liquids into chamber 16, fitting 42 may include a device (also not shown in any Figure) to restrict flow through the fitting to a rate which can be adequately drained through overflow port 44.

Figure 6:
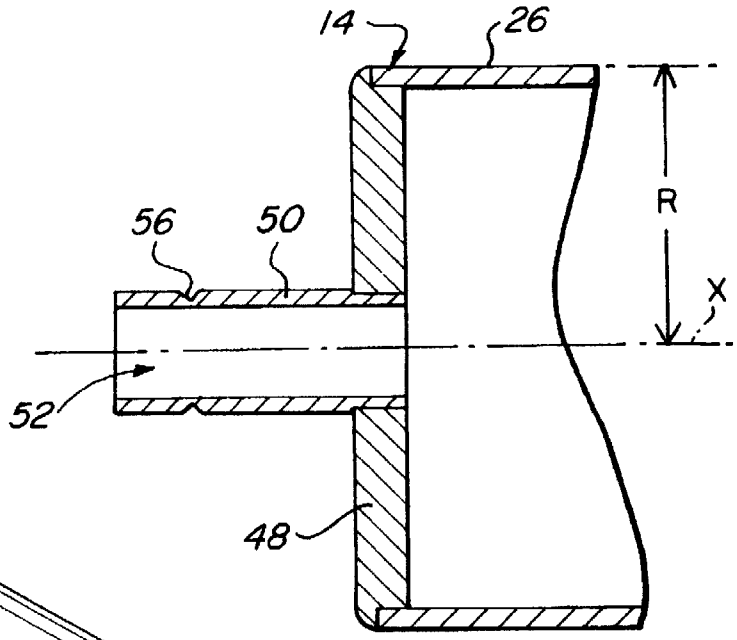
FIGS. 6 and 7 are partial, enlarged, cross-sectional views of the drum photographic processor of FIG. 1.
Figure 5:
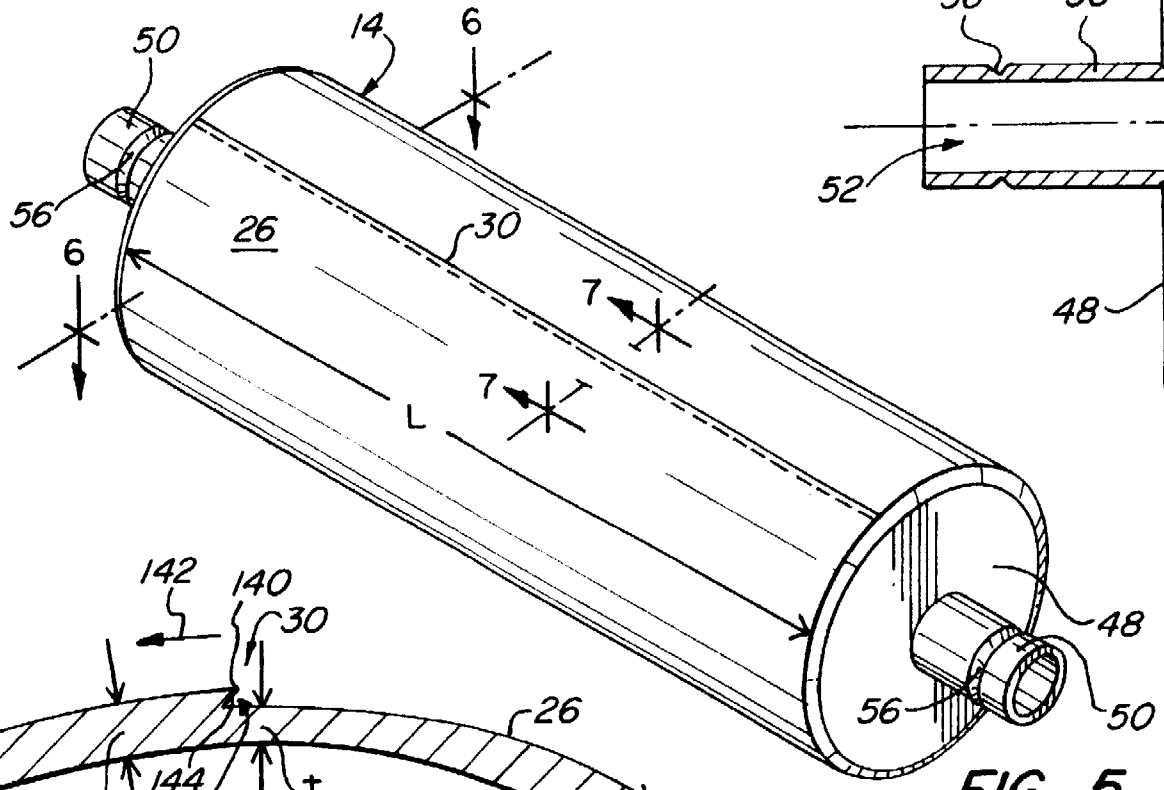
FIG. 5 is a front isometric view of the drum removed from the drum photographic processor of FIG. 1.

Referring briefly to FIGS. 5 and 6, drum 14 has ends 48 each of which include shaft or hub portions 50 mounted with their centers on axis X. Shaft portions 50 are illustrated as separate units, but it is understood that they may also be opposite ends of a single shaft. Cover 24 is substantially light-sealed around hub portions 50 without interfering with their rotation.

Drum 14 is preferably hollow and enclosed by ends 48 in order to provide the capability of altering or controlling characteristics of drum 14, such as its temperature, by introduction of material or liquid through passages 52 of shaft portions 50. It is understood that drum 14 could also be solid and that temperature or other characteristics could be controlled in another manner.

Returning to FIGS. 1 and 2, drum 14 is mounted in chamber 16 and supported by pairs of support rollers 54, 54'. Drum 14 is mounted so that only a small gap G is provided between drum outer surface 26 and trough 20. Gap G is sufficient to accommodate the thickness of photographic material 12 and a small amount of processing liquid 15. In this regard, the amount of processing liquid 15 necessary to develop material 12 may be minimized.

Rollers 54, 54' are respectively mounted on end walls 22, 22' and contact hub portions 50 at two points. Rollers 54, 54' support shaft portions 50 from beneath so that drum 14 may readily be removed and replaced from processor 10 by lifting it off the support rollers. For example, drums 14 of different lengths L may be substituted to process different size sheets of photographic material permitting use of the smallest necessary amount of processing liquid.

Drum shaft portions 50 include annular channels 56 for receiving resilient bands 58, 58' which are stretched around rollers 54, 54'. The resiliency of bands 58, 58' provides a cushioning function between shaft portions 50 and support rollers 54, 54' to provide a smooth rotation to drum 14. The resiliency also provides a gripping function to shaft portion 50 so that advancement of band 58 produces a positive but gentle rotation of drum 14. Preferably, annular channels 56 have a V-shaped cross section and bands 58, 58' have a round cross section sized to fit within channels 56 such that shaft portions 50 are self-aligning on rollers 54, 54' to properly position drum 14 within processing chamber 16.

Rollers 54 receive individual bands 58' each of which contacts annular groove 56 of the shaft portion at a single position. Rollers 54, however, are pulleys which receive a single band 58 and comprise a portion of drum rotating mechanism 18. Mechanism 18 also includes a tensioning pulley 60, a motorized pulley 62, a motor 64, and a shaft 65 for connecting motor 64 to motorized pulley 62 (see FIG. 3). Rollers 54' are freewheeling and do not rotate drum 14.

Figure 3:
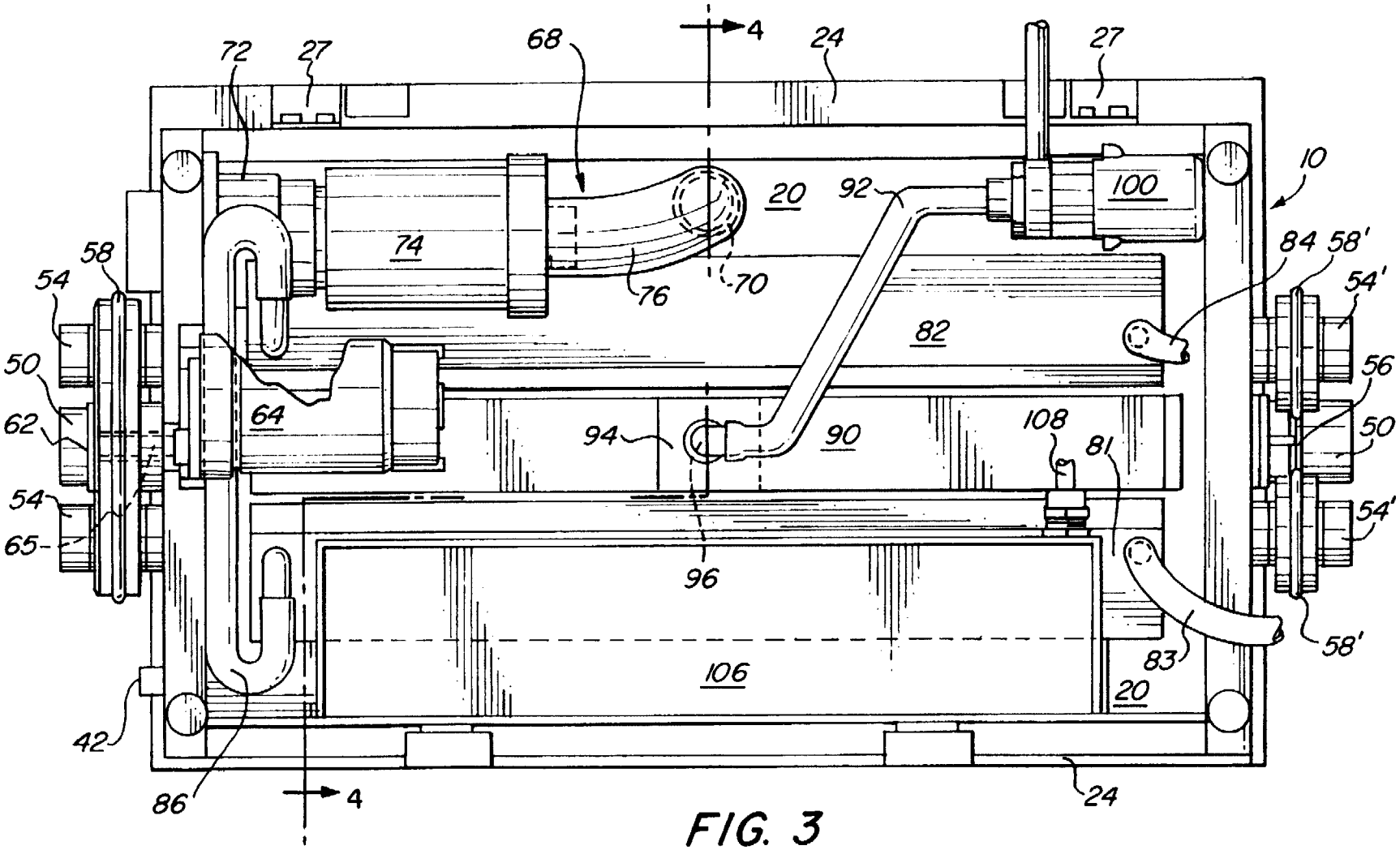
FIG. 3 is a bottom plan view of the drum photographic processor of FIG. 1.
Figure 4:
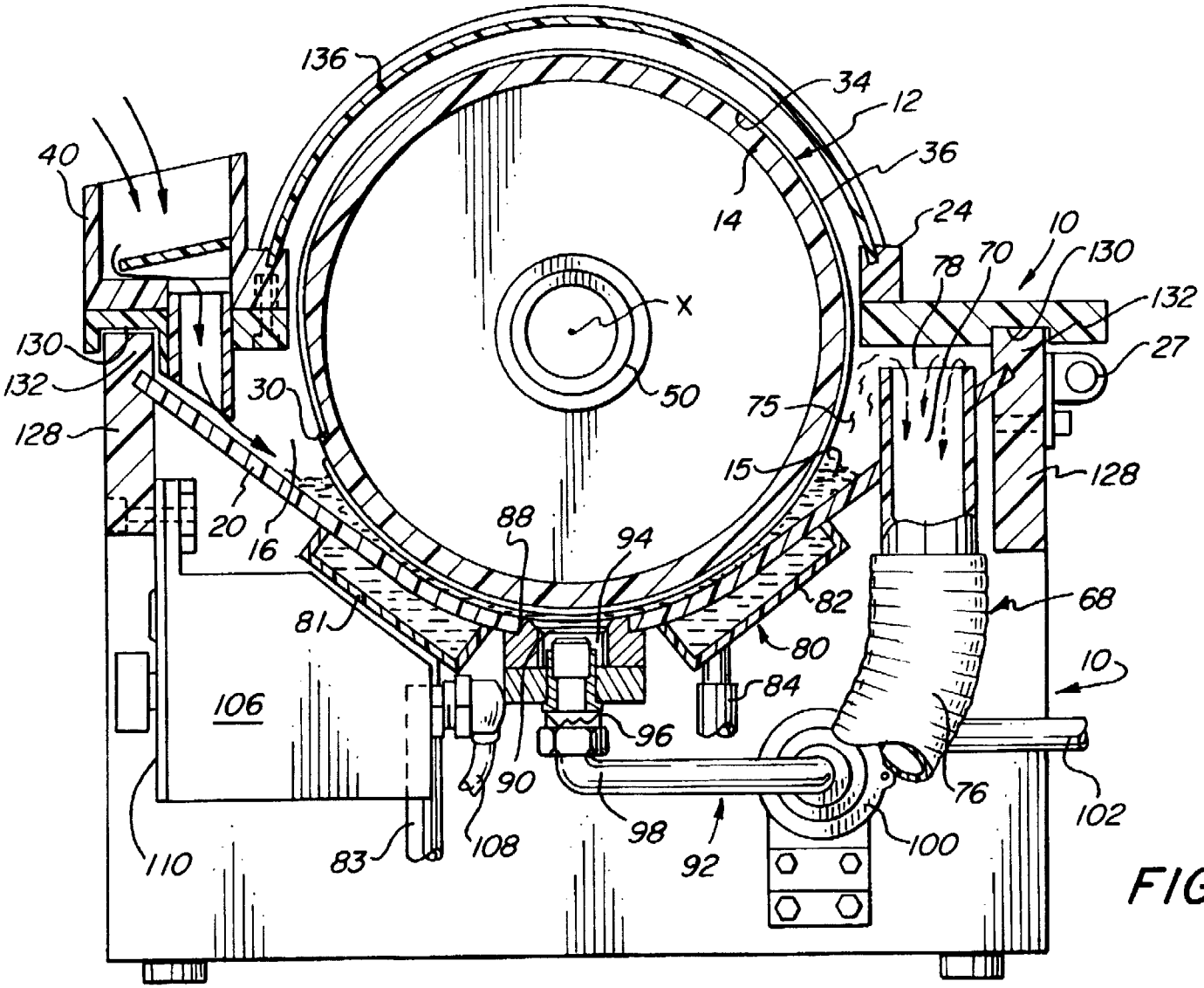
FIG. 4 is a right side cross-sectional view.

Referring now to FIGS. 1, 3 and 4, additional features of processor 10 are revealed in bottom plan and cross-sectional views. Processing chamber 16 includes a ventilation system 68 comprising an inlet 70, a fan 72 and a filter 74. An exhaust hose 76 connects inlet 70 with fan 72. Preferably fan 72 and filter 74 are mounted in processor 10 so that it may be used on a stand alone basis, but it is understood that the fan may be remotely located and that a filter may not be used. Filter 74 is preferably replaceable so that the filter can be matched to the fumes 75 emanating from various types of processing chemicals 15. Inlet 70 extends into processing chamber 16 through trough 20 and is preferably located on the opposite side of trough 20 from chemical inlets 40, 42 to reduce the possibility of liquid splashes entering the exhaust inlet. Upper rim 78 of exhaust inlet 70 is mounted at a point above overflow drain 44 (see FIG. 2) for the same reason.

Trough 20 also includes a temperature control system 80 comprising front and rear fluid jacket chambers 81, 82 mounted beneath and contacting trough 20 for substantially its entire length. A fluid inlet 83 is attached at one end of chamber 81 and a fluid outlet 84 is attached at the same end of chamber 82. A connecting pipe or hose 86 circulates fluid between jacket chambers 81, 82 at their other ends. Fluid inlet 83 may, for example, be connected to a device (not shown in any Figure) for heating or cooling liquid and supplying it at a constant temperature. In some instances, tap water may provide a sufficiently constant temperature source of fluid. Fluid outlet 84 may simply lead to a drain or may recirculate to the liquid heating/cooling device (not shown).

At the bottom 88, and extending substantially the entire length, of trough 20 between jacket chambers 81, 82 is a sump 90 forming part of a processing chemical removal system 92. Sump 90 slopes from near the ends toward the center of trough 20 such that sump 90 is deepest in the region 94 around check valve 96. Valve 96 is connected by a fluid line 98 to a pump 100. Pump 100 is utilized to quickly remove processing chemicals 15 from trough 20 to waste line 102. Check valve 96 insures that intermittent operation of pump 100 during processing does not permit waste chemicals in line 98 to return to trough 20 where they might damage processing.

Processor 10 includes a control box 106 which includes the switches, indicator lights and controls used to operate pump 100, fan 72, and motor 64 to process photographic images. Control box 106 is powered by line 108 which includes a plug or other electrical connector (not shown).

Referring now primarily to FIGS. 1 and 4, control box 106 includes a front panel 110. Control panel 110 includes five on-off switches with the following functions: motor 112, pump 114, power 116, timer 118, and exhaust fan 120. Each of these switches includes an associated indicator light as illustrated in FIG. 1. In addition to on-off switch 112, motor 64 also includes a variable speed control knob 122 for adjusting drum rotation speed.

Switch 118 actuates a timer, the setting or duration of which is adjustable by control knob 124. The timer includes an audible or other time-out indication which is useful in timing certain processing steps, and for processing multiple, identical copies of an image.

It is understood that all electrical equipment in processor 10 is suitably moisture-proofed and formed of material relatively impervious to photographic processing chemicals. It is further understood that processing chamber 16 is relatively light impervious.

Trough 20 is supported at the front and rear of processor 10 by structural rails 128 mounted between end walls 22, 22'. Cover 24 includes notches 130 for fitting over upper portions 132 of rails 128 to form a light-proof seal. Hinges 27 are connected to rear rail 128 for mounting cover 24 over trough 20, and control box 106 is connected to front rail 128.

Although cover 24 provides a light-proof seal over trough 20, it also includes a window 136 permitting the user to review the image throughout processing. Window 136 concentrically curves with drum outer surface 26 in order to minimize any distortion caused by lighting, refraction or otherwise. Window 136 is tinted so that transmitted light does not affect the photographic process used, and thus the developing procedure using processor 10 may be carried out in a lit room. Window 136 extends substantially the complete length and a substantial portion, at least one-quarter and preferably at least about one third, of the circumference of drum 14.

Window 136 permits the artist or photo enthusiast to review the image after each revolution of drum 14, if necessary, in order to obtain precisely the desired image. In combination with a pump for substantially instantaneously removing processing chemicals from trough 20, processor 10 essentially "digitizes" the developing process by dividing it up into a plurality of drum revolutions and permitting the user to alter or stop processing after each step.

Figure 7:
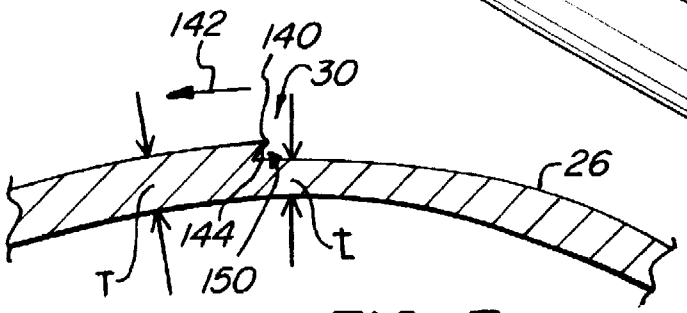

Referring now to FIG. 7 an enlarged, partial, cross-sectional view of drum 14 reveals additional detail of groove 30. Drum outer surface 26 tapers from a drum thickness T to a lesser thickness t in the region of groove 30 forming a lip 140 having a height equal to abut T-t. As drum 14 rotates in the direction of arrow 142, lip 140 prevents processing liquid from lifting a leading edge 28 of photographic material 12 (see FIG. 2) off of drum outer surface 26. Preferably, the height of lip 140 is only very slightly greater than a thickness of the photographic material to be developed so that the processing chemicals readily contact the entire emulsion side 36 of material 12.

Groove 30 preferably comprises an inverted wall 144 forming a wedge-shaped slot 150 for receiving the leading edge 28 in an interference fit without contacting emulsion side 36 of the photographic material (see FIG. 2). Inverted wall 144 slopes back in the direction of rotation 142 from lip 140 toward drum outer surface 26, and wedge-shaped slot 150 is formed between inverted wall 144 and the drum outer surface in the region of thickness t.

The invention also comprises a method of processing photographic material using processor 10. The steps of the method generally include: wetting drum outer surface 26 with an inert, non-reactive liquid such as water; inserting an edge 28 of the photographic material into groove 30; applying the sheet of material to the drum by advancing the drum and pressing the entire non-emulsion side 34 of the material into contact with the drum outer surface; rotating the drum to repeatedly dip or pass the entire emulsion side 36 of the material through the processing chemicals; viewing the developing of the image on the photographic material through window 136; and pumping the processing chemicals immediately out of trough 20 when the desired image is attained on material 12 as determined by viewing.

Where the photographic material used is paper, it is preferably soaked in inert liquid (e.g., water) prior to application to drum 14. In this case, the wet paper may itself, but need not, perform the step or function of wetting drum outer surface 26.

The edge inserting step preferably comprises locating the leading edge of photographic material 12 behind lip 140 so that the processing liquid will not lift edge 28 and strip material 12 off of outer surface 26 as drum 14 rotates. Most preferably, edge 28 is inserted into a wedge-shaped slot 150 in an interference fit to aid in retaining material 12 on drum 14 while permitting the processing liquids to completely contact emulsion side 36.

Additional steps in the process include washing the image with inert liquid (e.g., water) after processing in order to preserve image quality over time. Unwashed or poorly washed prints may continue to process or develop over time due to the presence of processing chemicals which may become embedded in photographic material 12. Image preservation is very important to artists and photo enthusiasts and thus complicated devices such as that illustrated in U.S. Pat. No. 4,332,455 have been developed to wash prints, film and the like. Such a device is necessary for use with many prior art developing devices and methods because the processing liquids are able to contact both the emulsion and the non-emulsion sides of the photographic material. However, processor 10 and the method of using it only permit chemicals to contact the emulsion side 36 of photographic material so that the difficulty of archival washing is reduced by about one-half. Second, the rotation of drum 14 provides sufficient agitation of inert fluid to wash processed images without water jets or other circulation devices. Third, washing can be accomplished without requiring a user to handle and potentially damage by creasing or otherwise the photographic material.

Finally, the rotation speed of drum 14 can be set with knob 122 (see FIG. 1) so that a user can effectively review the developing image after each pass through the developing liquid and, if desired, immediately pump the liquid out of the trough. Prior art systems do not provide this level of control over the developing process either because developing can not be viewed, or because developing liquid can not be so immediately removed from contact with the photographic material, or both. Overall, the invention provides a combination of features enabling developing of high quality, large scale prints with an unmatched degree of efficiency and control.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A device for processing photographic sheet material with liquids to generate high quality, large scale photographic images comprising:

a trough for receiving the liquid;

a drum mounted within said trough in contact with the liquid, said drum having an outer surface for mounting the photographic sheet material such that a non-emulsion side of the sheet material contacts the drum outer surface;

motor means for rotating said drum outer surface to pass an emulsion side of the sheet material repeatedly through the liquid in said trough;

a groove on said outer surface of said drum for receiving an edge of the photographic material;

a cover for enclosing said trough and drum outer surface, said cover including a window extending along said drum permitting a user to view the photographic material during processing;

a pump connected to said trough for removal of liquids from the trough to drum hub portions extending from ends of said drum and along an axis of said drum, said hub portions for mounting said drum within said trough; and a pair of support rollers mounted near ends of said trough supporting said hub portions.

2. The photographic processing device of claim 1 wherein said groove comprises a lip having a height substantially equal to at least about a thickness of the photographic material.

3. The photographic processing device of claim 2 wherein said groove comprises an inverted wall defining a wedge-shaped slot for receiving the edge of the photographic material.

4. The photographic processing device of claim 1 including a blower and filter connected to said trough for evacuating and filtering fumes from the liquids.

5. The photographic processing device of claim 1 including resilient bands stretched around said support rollers to cushion and grip said hub portions.

6. The photographic processing device of claim 5 wherein said motor means comprises a motorized pulley around which one of said bands extends, said motorized pulley for advancing said one band.

7. The photographic processing device of claim 6 wherein said pair of support rollers comprise support pulleys around which said one band extends, said pair of support pulleys for supporting one of said drum hub portions at two points.

8. The photographic processing device of claim 7 wherein said motor means comprises a tensioning pulley around which said one band extends, said tensioning pulley located between said support pulleys and movable to extend a path length of said band.

9. The photographic processing device of claim 8 wherein said motorized pulley, said tensioning pulley and said support pulleys are all mounted on a first end of said trough, and including a second pair of support rollers mounted on a second end of said trough, said support rollers receiving at least another of said bands for cushioning and gripping the other of said drum hub portions.

10. The photographic processing device of claim 6 wherein rotation of said motorized pulley is reversible through substantially 360° to more readily enable loading and unloading of the photographic material.

11. The photographic processing device of claim 1 wherein said window extends around at least about one third of the circumference of said drum.

12. A device for processing photographic sheet material with liquids to generate photographic images comprising:

a trough for receiving the liquid;

a drum mounted within said trough in contact with the liquid, said drum having an outer surface for mounting the photographic sheet material such that a non-emulsion side of the sheet material completely contacts the drum outer surface;

motor means for rotating said drum outer surface to pass an emulsion side of the sheet material through the liquid in said trough;

a groove in said outer surface of said drum, said groove having an inverted wall defining a wedge-shaped slot for receiving an edge of the photographic material in an interference fit to aid in retaining the sheet material on the drum outer surface, said groove defining a lip for shielding the edge of the photographic material and preventing the liquid from peeling the photographic material off of said drum surface as it is rotated through the liquid; and a pair of rollers for supporting said drum, said motor means for rotating one of said rollers to rotate said drum.

13. The photographic processing device of claim 12 including a pump connected to said trough for removal of liquids from the trough.

14. The photographic processing device of claim 12 including a cover for enclosing said trough and drum outer surface, said cover including a window concentrically curving with a circumference of said drum and extending along said drum permitting a user to view the photographic material during processing with a minimum of distortion.

15. The photographic processing device of claim 12 including at least one resilient band for stretching around said rollers to cushion the point of contact between said drum and said rollers.

16. A method of producing images on photographic material with a drum processor including the steps of:

wetting the drum outer surface with an inert liquid;

inserting an edge of the photographic material into a groove on an outer surface of the drum;

applying the photographic material to the drum by advancing the drum up to one revolution and insuring that a non-emulsion side of the material is completely in contact with the drum outer surface;

rotating the drum to pass the photographic material completely through processing liquid within a trough;

viewing the photographic material through a window in a cover on the trough; and pumping the processing liquid out of the trough upon obtaining a desired image on the photographic material as determined by viewing.

17. The photographic image producing method of claim 16 including the additional step of washing only the emulsion side of the photographic material in inert liquid.

18. The photographic image producing method of claim 16 wherein said viewing step comprises viewing the photographic material after each revolution of the drum such that pumping may be initiated after each passage of the photographic material through the processing liquid.

* * * * *